US005865643A

United States Patent [19]

Suzuki

[11] Patent Number: 5,865,643

[45] Date of Patent: Feb. 2, 1999

[54] TERMINAL FOR BATTERY ELECTRODES

[75] Inventor: Masao Suzuki, Tokyo, Japan

[73] Assignee: Thomas & Betts Corporation, Memphis, Tenn.

[21] Appl. No.: 969,980

[22] Filed: Nov. 13, 1997

Related U.S. Application Data

[63] Continuation of Ser. No. 558,360, Nov. 16, 1995, abandoned.

[51] Int. Cl.[6] ..... H01R 3/00

[52] U.S. Cl. ..... 439/500; 439/862

[58] Field of Search ..... 439/79, 289, 500, 439/626, 660, 862; 429/53, 86, 96–100, 174, 176, 185

[56] References Cited

U.S. PATENT DOCUMENTS

| | | | |
|---|---|---|---|
| 3,984,257 | 10/1976 | Zurcher | 429/96 |
| 4,201,432 | 5/1980 | Chalmers | 439/660 |
| 4,270,834 | 6/1981 | Woller et al. | 439/500 |
| 4,718,742 | 1/1988 | Utoh et al. | 429/100 |
| 4,891,019 | 1/1990 | Olsson | 439/404 |
| 5,024,605 | 6/1991 | Kasatani et al. | 429/99 |
| 5,052,943 | 10/1991 | Davis | 439/660 |
| 5,458,498 | 10/1995 | Ii et al. | 439/71 |
| 5,647,749 | 7/1997 | Atoh et al. | 439/79 |
| 5,655,913 | 8/1997 | Castaneda et al. | 439/862 |
| 5,697,816 | 12/1997 | Wu | 439/660 |

*Primary Examiner*—Paula Bradley
*Assistant Examiner*—Tho D. Ta
*Attorney, Agent, or Firm*—Hoffmann & Baron, LLP

[57] ABSTRACT

The present device provides a terminal mounted on the surface of a printed circuit board and, more particularly, to a terminal used for reliably contacting the electrodes of a battery. In a terminal comprising a housing and a plurality of spring contacts mounted in the housing, the curved parts of the spring sections of the spring contacts extend externally from one surface of the housing in different arrangement. Since the positions of the curved parts are different, the spring actions of the contacts against the contact target members are not localized. Even if the shape of the contact target members varies largely, these members can be held reliably.

6 Claims, 4 Drawing Sheets

TERMINAL FOR BATTERY ELECTRODES

This application is a continuation, of application Ser. No. 08/558,360 filed Nov. 16, 1995, now abandoned.

FIELD OF THE INVENTION

The present device relates to a terminal mounted on, e.g., the surface of a printed circuit board and, more particularly, to a terminal used for contacting the electrodes of a battery.

BACKGROUND OF THE INVENTION

As a terminal of this type, one obtained by arranging a plurality of spring contacts having the same shape in a housing in the longitudinal direction of the housing is generally used. Accordingly, the portions of all these contacts through which the contacts contact the contact target members are disposed on one line.

When the portions of the contacts through which the contacts contact target members are disposed on one line, the spring actions of the contacts against the contact target members are localized, leading to an inconvenience in holding these members. In particular, when the corresponding areas (electrodes) of the contact target members are large or when the shape of these members varies largely, this arrangement causes a disadvantage.

SUMMARY OF THE INVENTION

The present device has been made to solve the above drawback, and has as its object to provide a terminal comprising a housing and a plurality of spring contacts mounted in the housing wherein the curved parts of the spring sections of the spring contacts extend externally from one surface of the housing in different arrangement.

Furthermore, according to the present device, there is provided a terminal wherein the housing is of right angle type, and the spring sections of the spring contacts extend so that the curved parts thereof may be located at high and low levels on a side surface of the housing.

DETAILED DESCRIPTION OF THE PREFERRED EMBODIMENT

Figure 1:
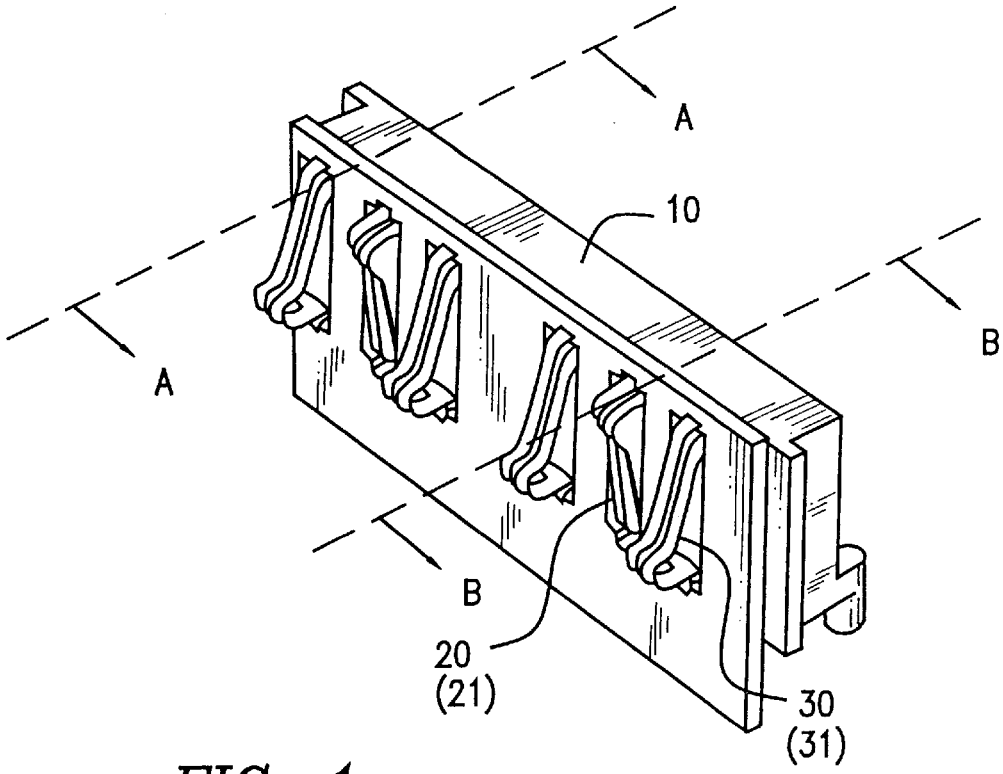
FIG. 1 is a perspective front view of an embodiment of a terminal according to the present device.

FIG. 1 shows a terminal according to an embodiment of the present device. The present device will be described with reference to the accompanying drawings.

The terminal of the present device is brought into contact with, e.g., the electrodes of a battery, through spring contacts 10, so that the terminal and the electrodes of the battery are electrically connected to each other.

The terminal of the present device is constituted by a housing 10 and a plurality of spring contacts 20 and 30. Each spring contact is constituted by a spring section 21 or 31, a leg portion 23 or 33, or fixing portion 24 or 34 for coupling the spring section and the leg portion to each other (see FIGS. 5 to 8). The spring contacts are respectively mounted in contact accommodating grooves 11 formed in the housing. The plurality of spring contacts are disposed such that the curved parts of the spring sections extend externally from one surface of the housing in different arrangement.

The housing of the embodiment shown in FIG. 1 is of right angle type, and the spring sections of the spring contacts extend so that the curved parts thereof may be located at high and low levels on a side surface of the housing. More specifically, the spring sections of the plurality of spring contacts are so arranged that their curved portions may be partially or entirely zigzagged along the longitudinal direction of the housing.

The leg portions 22 or 32 extend from the bottom surface of the housing and are electrically brought into contact with, e.g., a printed circuit board, with a known means.

Figure 2:
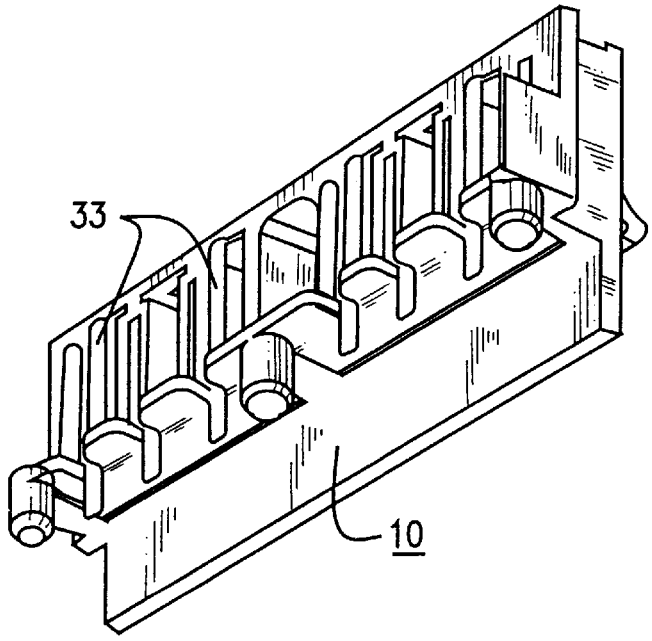
FIG. 2 is a perspective rear view of the terminal as shown in FIG. 1.
Figure 3:
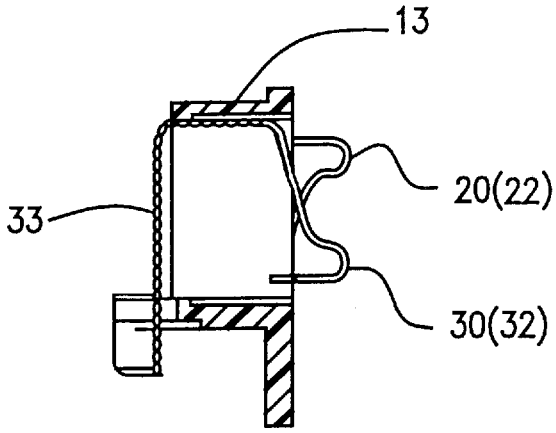
FIG. 3 is a sectional view taken along the line A—A of FIG. 1.

FIGS. 2 and 3 are longitudinal sectional views of the embodiment shown in FIG. 1. As is apparent from FIGS. 2 and 3, the curved parts of the spring contacts may be located at high and low levels.

Figure 4:
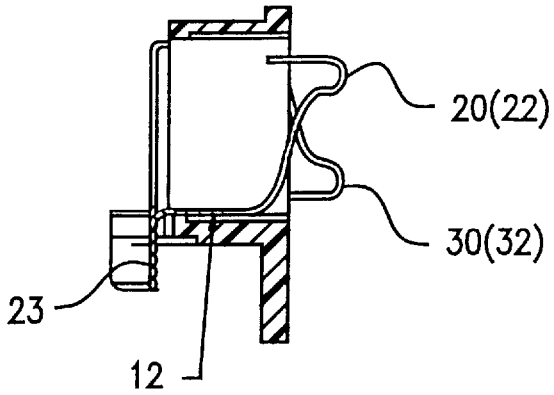
FIG. 4 is a sectional view taken along the line B—B of FIG. 1.

FIG. 4 is a rear-surface perspective view of the embodiment shown in FIG. 1, from which the arrangement of the leg portions of the spring contacts is apparent.

Figure 5:
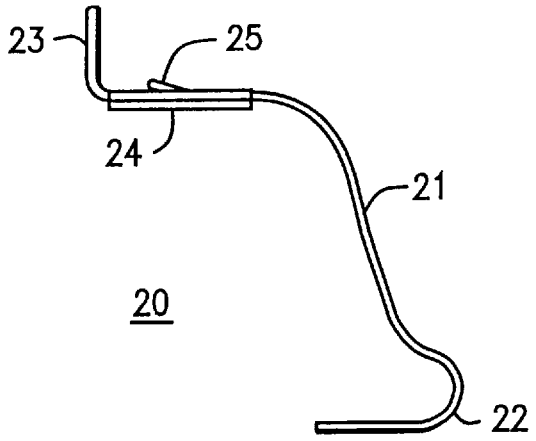
FIG. 5 is a front view of one type contact of the terminal as shown in FIG. 1.
Figure 6:
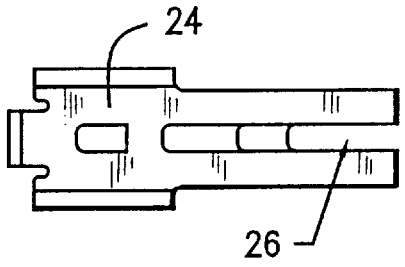
FIG. 6 is a plan view of the contact as shown in FIG. 5.
Figure 7:
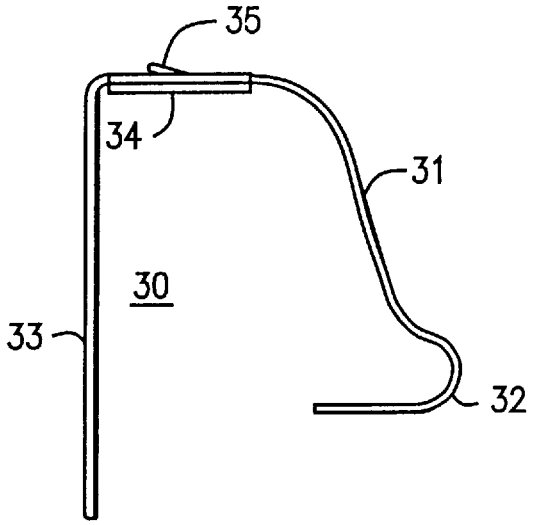
FIG. 7 is a front view of the other type of contact of the terminal as shown in FIG. 1.
Figure 8:
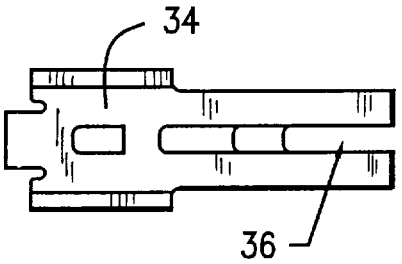
FIG. 8 is a plan view of the contact as shown in FIG. 7.

FIGS. 5 and 6 show one type 20 of the contact used in the embodiment of the present device. This contact is used when the position of the curved part 21 is at a high level. In FIG. 6, reference numeral 26 denotes a slit formed in the spring section. FIGS. 7 and 8 show the other type 30 of the contact used in the embodiment of the present device. This contact is used when the position of the curved part 31 is at a low level. In FIG. 8, reference numeral 36 denotes a slit formed in the spring section. These contacts are of the same shape except for their leg portions.

The contact 20 shown in FIGS. 5 and 6 is fixed by fitting its fixing portion 24 in a groove 12 formed in the lower wall surface of the accommodating groove of the housing. The contact 30 shown in FIGS. 7 and 8 is fixed by fitting its fixing portion 34 in a groove 13 formed in the upper wall surface of the accommodating groove of the housing. A pawl 25 or 35 formed at the fixing portion of the contact serves as the stopper.

In the terminal of the present device, since the positions of the portions (curved parts) of the contacts through which the contacts contact the contact target members (e.g., the electrodes of a battery) differ (e.g., zigzagged), the contact portions (electrodes) of the contact target members are also arranged in the zigzag manner, so that the gaps between the adjacent electrodes are widened, thereby increasing the areas of the gaps between the adjacent electrodes.

Similarly, since the positions of the curved parts differ, the spring actions of the contacts against the contact target members are not localized. Even if the corresponding areas (electrodes) of the contact target members are large or even if the shape of the contact target member varies largely, these members can be reliably held.

Various changes to the foregoing described and shown structures would now be evident to those skilled in the art. Accordingly, the particularly disclosed scope of the invention is set forth in the following claims.

What is claimed is:

1. An electrical connector comprising:

an elongate insulative housing having a side surface and a plurality of adjacently spaced-apart exteriorly opening grooves extending along said side surface; and a plurality of electrical contacts supported by said housing within said grooves, said contacts including identically configured elongate spring sections extending exteriorly of said side surface, each said spring section having a curved part adjacent a distal end thereof for spring engagement with electrodes of a battery said contacts further including leg portions of at least two different configurations extending from a lower housing wall;

said contacts being arranged in said housing so that said of adjacent said spring sections contacts in alternate reverse orientation thereby transversely spacing said curved part of one of said spring sections from said curved part of said adjacent spring section in zig zagged fashion and said leg portions of said contacts extending from said lower housing wall in mutually aligned orientation in a single row.

2. An electrical connector of claim 1 wherein said curved parts of said spring sections are arranged in two transversely spaced longitudinally aligned rows.

3. A connector of claim 1 wherein spring sections of said contacts each include a slit extending therethrough.

4. An electrical connector of claim 1 wherein said contacts further include contact fixing portions for securing said contacts in said housing.

5. A connector of claim 4 wherein said housing includes an upper and lower housing wall, said contacts being fixed in said housing alternately in said upper and lower housing walls.

6. A connector of claim 5 wherein each said contact further includes a leg section extending from said contact fixing portion for exterior electrical connection.

* * * * *

UNITED STATES PATENT AND TRADEMARK OFFICE

CERTIFICATE OF CORRECTION

PATENT NO. : 5,865,643
DATED : February 2, 1999
INVENTOR(S) : Masao Suzuki

It is certified that error appears in the above-indentified patent and that said Letters Patent is hereby corrected as shown below:

At column 3, lines 13-14, delete "said of adjacent spring section contacts in alternate" and insert therefor --said spring sections of adjacent said contacts extend in alternate--.

Signed and Sealed this

Twenty-fourth Day of August, 1999

*Attest:*

Q. TODD DICKINSON

*Attesting Officer*

*Acting Commissioner of Patents and Trademarks*